US007229424B2

(12) United States Patent
Jones et al.

(10) Patent No.: US 7,229,424 B2
(45) Date of Patent: Jun. 12, 2007

(54) HAND HELD MASSAGE DEVICE WITH REMOVABLE HANDLE

(75) Inventors: Rick E. Jones, Rocklin, CA (US); Robert Off, Escondido, CA (US)

(73) Assignee: Babacu International. Inc., Rocklin, CA (US)

( * ) Notice: Subject to any disclaimer, the term of this patent is extended or adjusted under 35 U.S.C. 154(b) by 5 days.

(21) Appl. No.: 11/307,437

(22) Filed: Feb. 7, 2006

(65) Prior Publication Data

US 2006/0116614 A1 Jun. 1, 2006

Related U.S. Application Data

(63) Continuation-in-part of application No. 10/868,992, filed on Jun. 15, 2004, now abandoned.

(51) Int. Cl.
*A61H 1/00* (2006.01)

(52) U.S. Cl. ..... 601/46; 601/73

(58) Field of Classification Search ..... 601/46, 601/72–73; 439/373, 369, 660; 81/477
See application file for complete search history.

(56) References Cited

U.S. PATENT DOCUMENTS 3,847,038 A * 11/1974 Green ..... 81/477
4,149,530 A 4/1979 Gow
4,757,806 A 7/1988 Muchisky et al.
4,846,158 A 7/1989 Teranishi
6,443,753 B1 * 9/2002 Bludis et al. ..... 439/373
6,969,384 B2 * 11/2005 de Juan et al. ..... 606/1
2002/0115353 A1 * 8/2002 Zeiler et al. ..... 439/660

* cited by examiner

*Primary Examiner*—Michael A. Brown
(74) *Attorney, Agent, or Firm*—Kelly Lowry & Kelley LLP

(57) ABSTRACT

The present invention provides a hand-held massage assembly that is modular and allows a user the option of using a roller mechanized massager with or without a handle. In accordance with an embodiment of the present invention, the hand-held massage assembly includes a roller mechanized massager having an electro-mechanical connection. A handle is connectable to the electro-mechanical connection on the roller mechanized massager by a first electro-mechanical connection at one end thereof. The handle also has a second electro-mechanical connection at an opposite end. The first electro-mechanical connection and second electro-mechanical connection of the handle are electrically coupled to each other. A power cord having an electro-mechanical connection is coupled to the second electro-mechanical connection on the handle. All of the electro-mechanical connections are designed such that the handle may be removed from the assembly and the electro-mechanical connection of the power cord may be coupled directed to the electro-mechanical connection of the roller mechanized massager.

21 Claims, 7 Drawing Sheets

HAND HELD MASSAGE DEVICE WITH REMOVABLE HANDLE

BACKGROUND OF THE INVENTION

The present invention generally relates to a massage device. More particularly, the present invention relates to a hand-held massage device with a removable handle.

Massaging devices for stimulating the skin, muscles and blood circulation are well known. In general, hand-held massage devices are difficult to use on oneself and require the use of a second party in order for a user to avoid having to twist and contort their body in order to reach relatively inaccessible portions of a user's back. Handles on conventional devices have been used to reduce the amount of twisting and contortion necessary for a user to reach those hard-to-get spots, but the handle of the massage device can be obtrusive and make it difficult for a user to manipulate the massage device when the user desires to reach a relatively easy-to-reach spot, such as the user's shoulders or to use conveniently with the hand hold without the requirement of the handle as an obstruction to the therapy. Therefore existing hand-held massagers can be much less effective if they require the presence of a second party to reach the hard-to-get spots on the user's back and if the handle of the device makes it difficult for the user, on their own, to manipulate the device so the user can massage a portion of their body such as their shoulders.

A number of devices have been created for the purpose of providing a massage. For example, U.S. Pat. No. 4,757,806, discloses a portable massage unit. However, the massage unit is bulky and its reach limited as the massage applicator is connected to a relatively large power unit by a relatively short cord. In another example, U.S. Pat. No. 4,846,158, discloses a hand-held massage device having a vibrating head spring mounted on a handle. However, the hand-held device requires the use of a fixed handle and a power cord both of which are permanently attached to the massage device. U.S. Pat. No. 4,149,530, discloses a hand held electric massager that includes a spherical vibrating portion and a handle portion permanently attached thereto. The handle portion contains a rechargeable battery connectable to a recharging unit. As with the other devices, the handle is permanently attached to the spherical vibrating portion of this invention.

Accordingly, there is a need for a hand-held massage device that is modular. There is also a need for a hand-held massage device that allows a user the ability to reach hard-to-get spots while allowing the user to also more easily manipulate the device when massaging their shoulders or arms. There is a further need for a hand-held massage device which allows a user the option of using the device with or without a handle. The present invention satisfies these needs and provides other related advantages.

SUMMARY OF THE INVENTION

The present invention provides a hand-held massage assembly that is modular and allows a user the option of using a vibratory or roller mechanized massager with or without a handle. In accordance with an embodiment of the present invention, the hand-held massage assembly includes a massager having an electro-mechanical connection. A handle is connectable to the electro-mechanical connection on the massager by a first electro-mechanical connection at one end thereof. The handle also has a second electro-mechanical connection at an opposite end. The first electro-mechanical connection and second electro-mechanical connection of the handle are electrically coupled to each other. A power cord having an electro-mechanical connection is coupled to the second electro-mechanical connection on the handle. All of the electro-mechanical connections are designed such that the handle may be removed from the assembly and the electro-mechanical connection of the power cord may be coupled directed to the electro-mechanical connection on the massager. The electro-mechanical connections may comprise threaded male and threaded female connectors. Alternatively, the electro-mechanical connections may comprise channel and lug connectors.

The handle of the assembly may include an articulating joint through which the first electro-mechanical connection remains electrically coupled to the second electro-mechanical connection.

The massager has two or more massaging surfaces. The first massaging surface has a hemispherical surface including three protrusions from a pole of the hemispherical surface, the protrusions arranged in a fixed pattern. The second massaging surface has three spheres protruding from a flat surface, the spheres held in place by a magnetic field and a clamp having a central hemispherical protrusion, i.e., the Acu•Nob™. The second massaging surface revolves about a central axis.

Other features and advantages of the present invention will become apparent from the following more detailed description, taken in connection with the accompanying drawings which illustrate, by way of example, the principals of the present invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
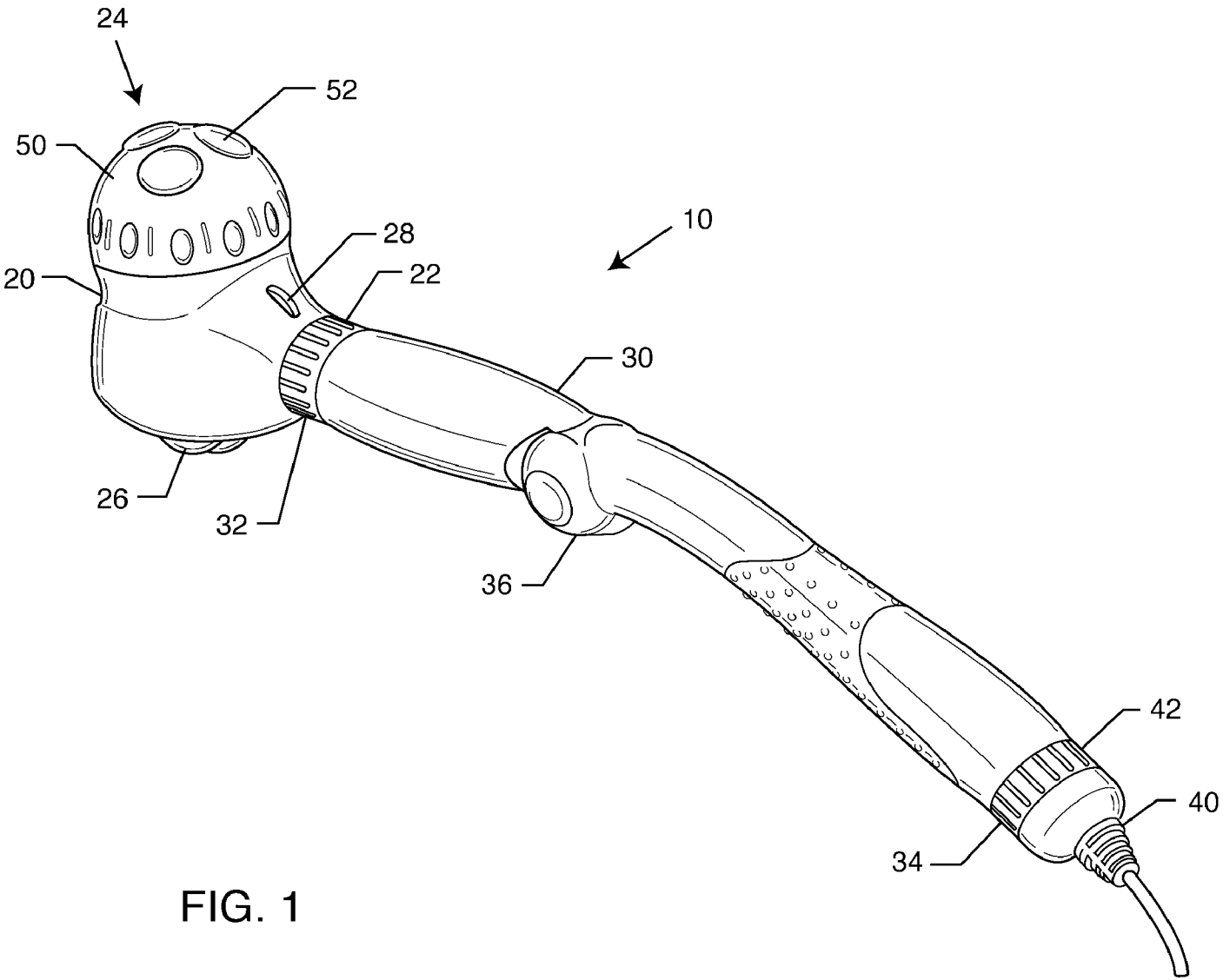
FIG. 1 is an orthogonal view of a hand held massage device including a roller mechanized massager, an articulating handle, and a power cord embodying the present invention.
Figure 2:
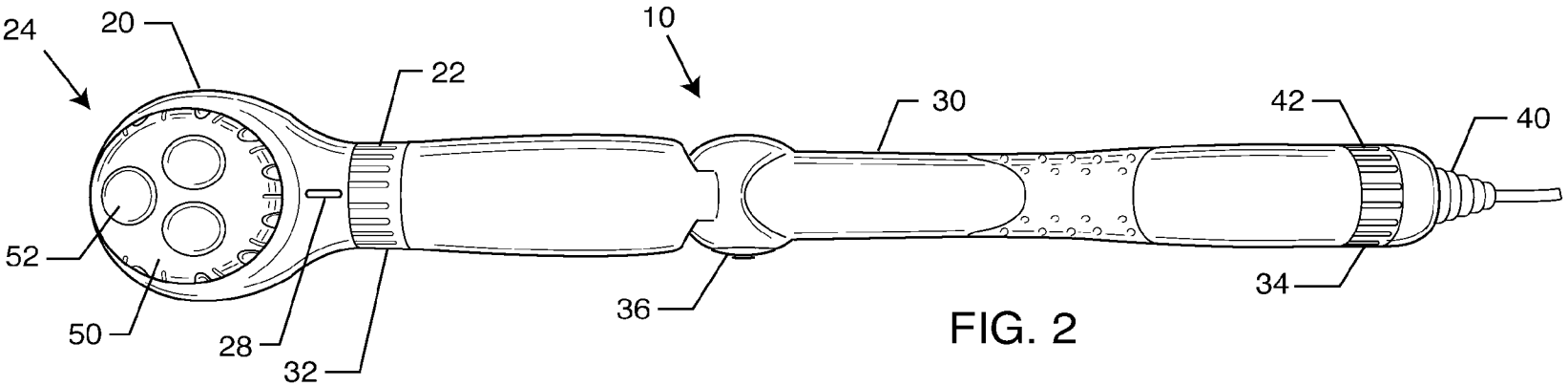
FIG. 2 is a top view of the massage device of FIG. 1.
Figure 3:
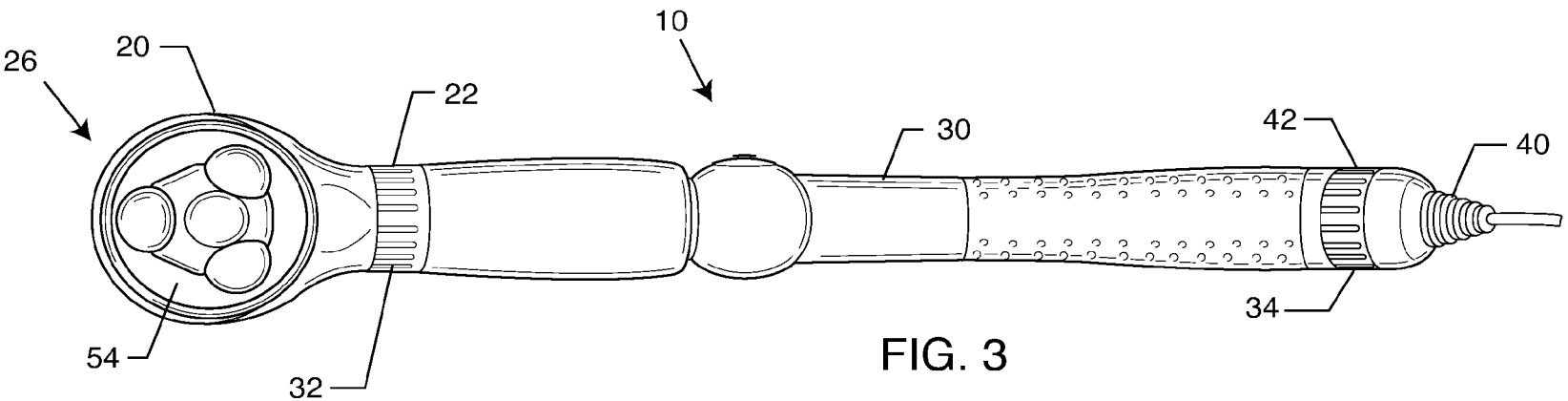
FIG. 3 is a bottom view of the massage device of FIG. 1.
Figure 4:
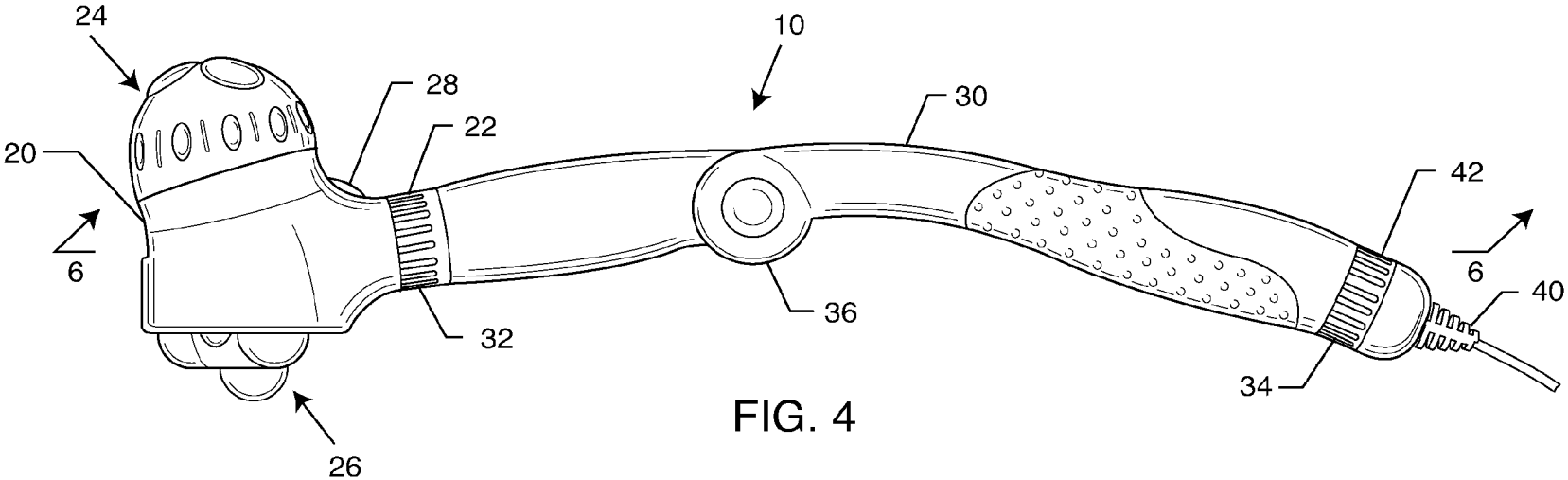
FIG. 4 is a side view of the massage device of FIG. 1.
Figure 5:
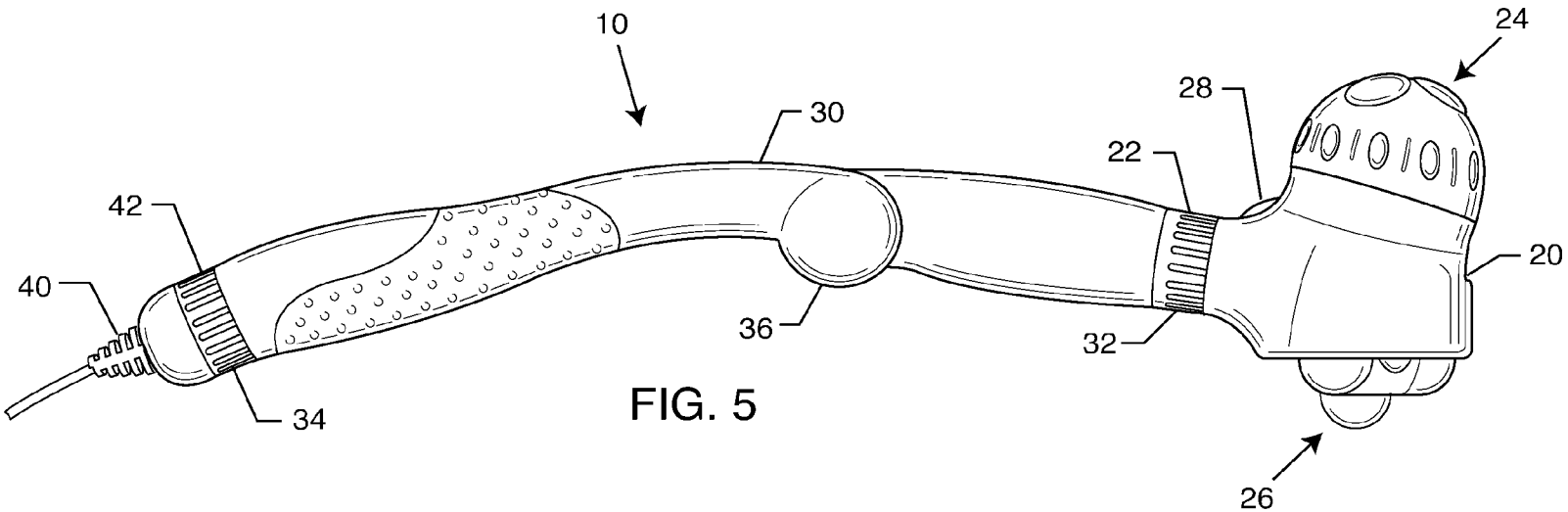
FIG. 5 is an opposite side view of the massage device of FIG. 1.
Figure 6:
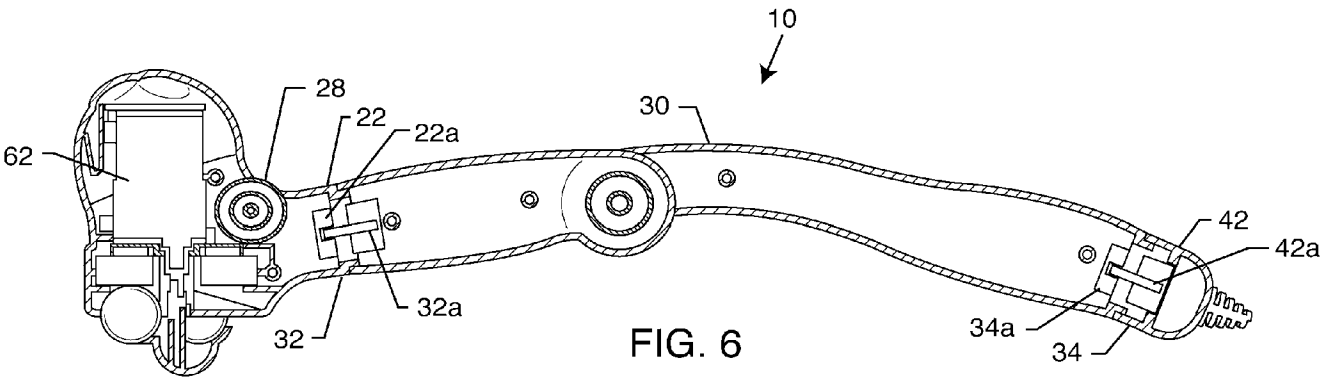
FIG. 6 is a cross-section of the massage device of FIG. 4 taken along line 6-6.
Figure 7:
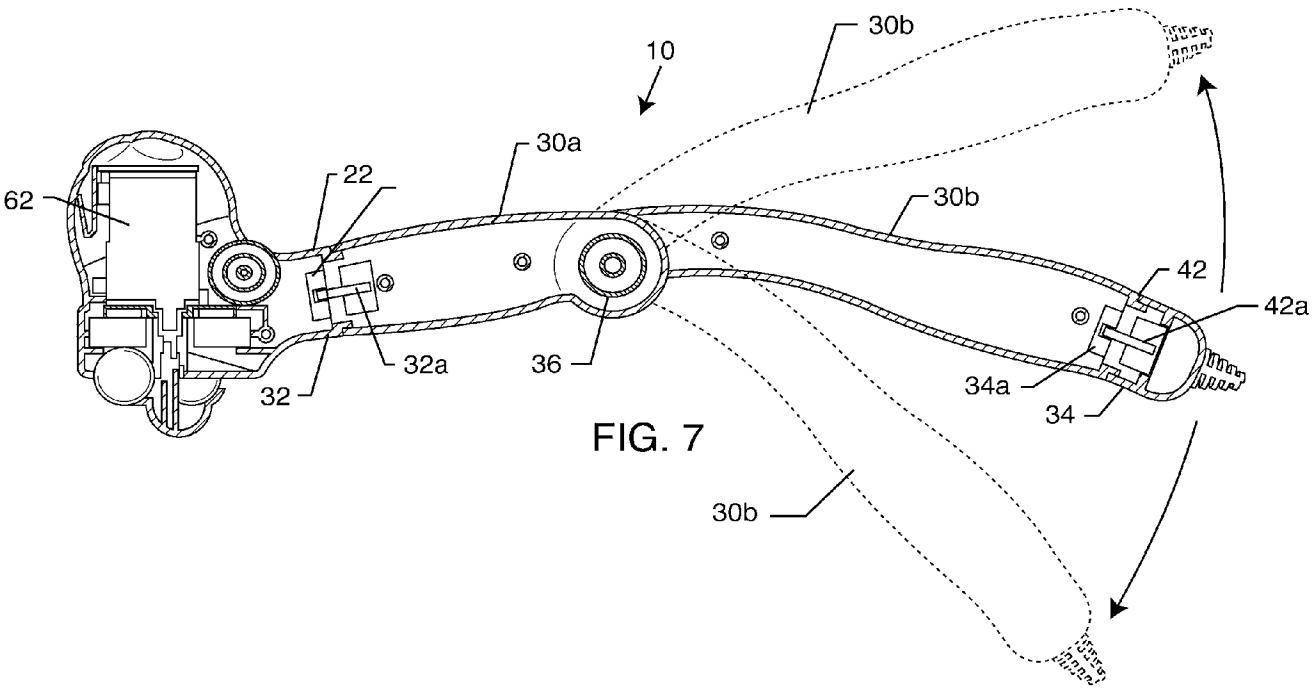
FIG. 7 is the cross-sectional view of FIG. 6 demonstrating the articulating motion of the handle.
Figure 8:
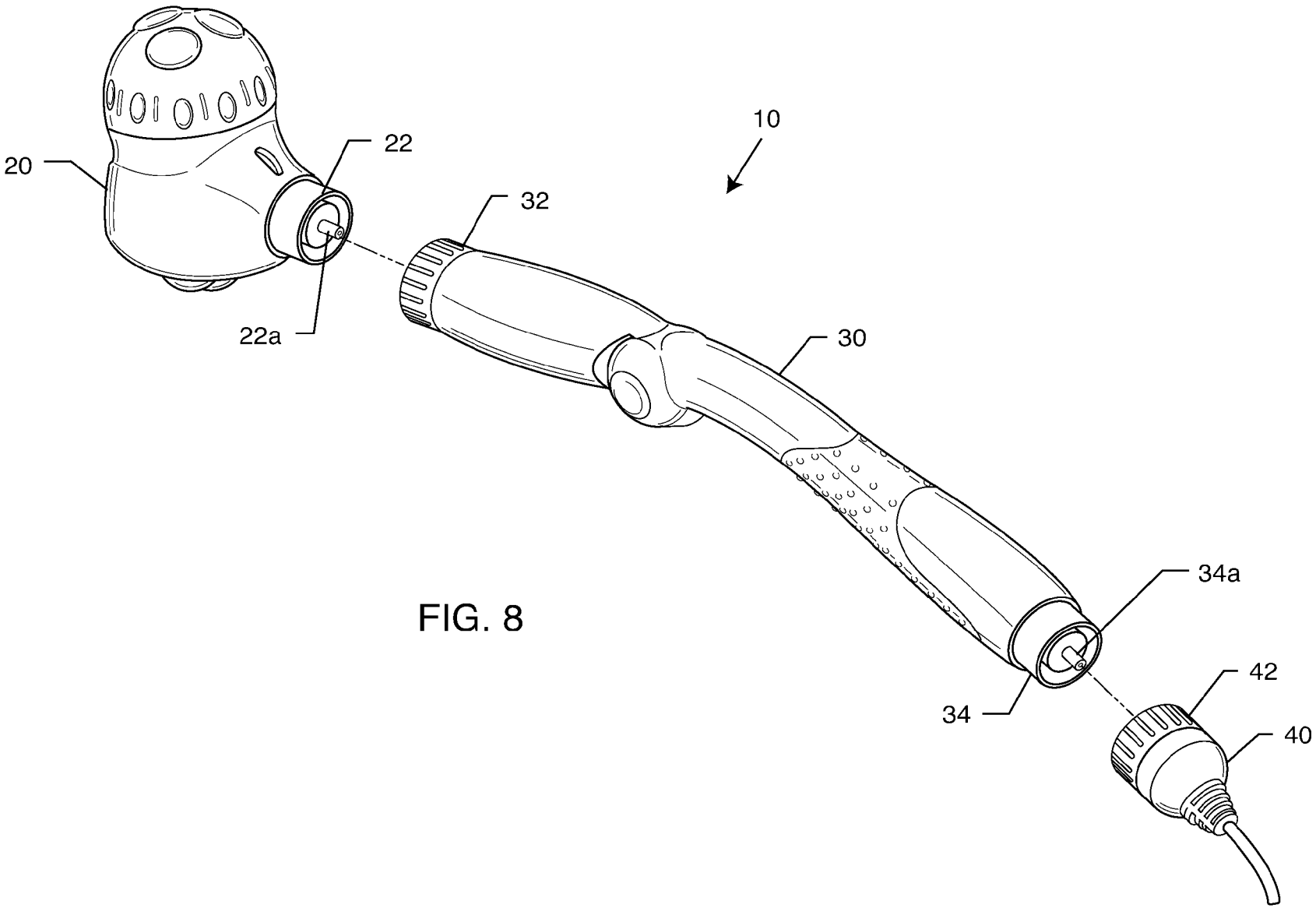
FIG. 8 is an exploded orthogonal view of the massage device of FIG. 1 showing the separate elements of the roller mechanized massager, the articulating handle, and the power cord.
Figure 10:
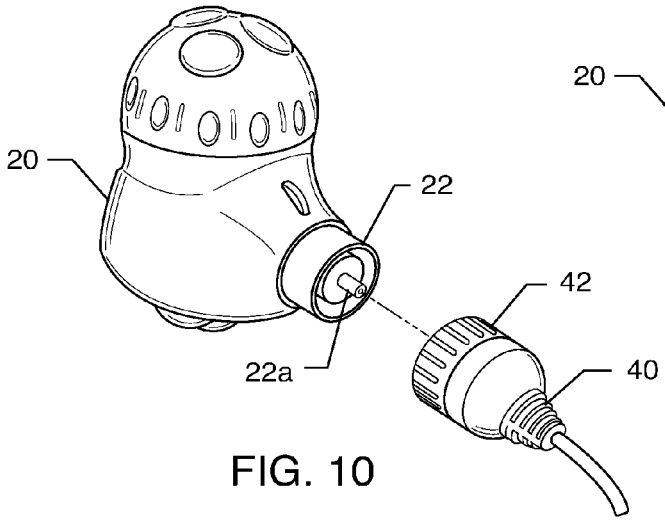
FIG. 10 is an exploded view of the massage device of FIG. 9.
Figure 9:
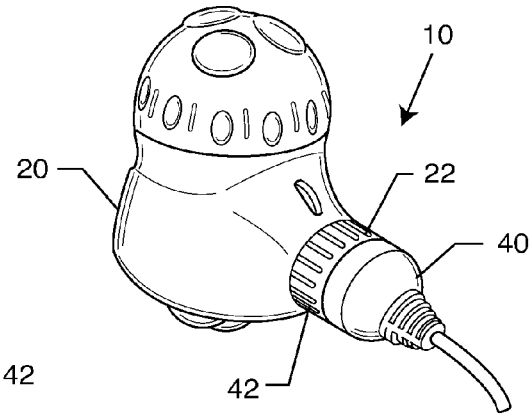
FIG. 9 is an orthogonal view of the massage device of FIG. 1 without the handle wherein the power cord is connected directly to the roller mechanized massager.
Figure 11:
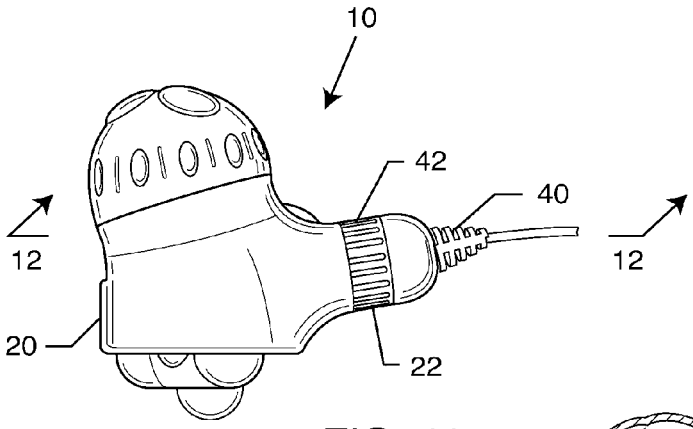
FIG. 11 is a side view of the massage device of FIG. 9.
Figure 12:
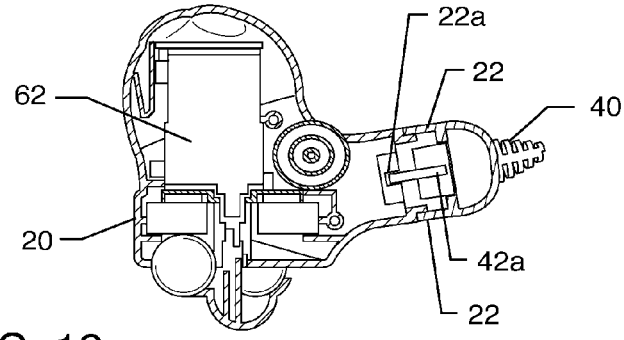
FIG. 12 is a cross-sectional view of the massage device of FIG. 11 taken along line 12-12.
Figure 13:
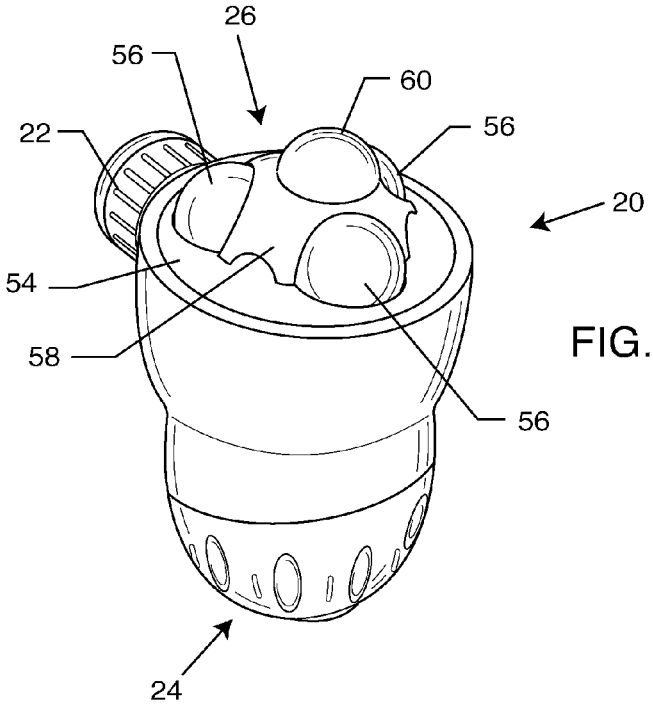
FIG. 13 is an orthogonal view of the roller mechanized massager depicting the second massaging surface called the Acu•Nob™.
Figure 14:
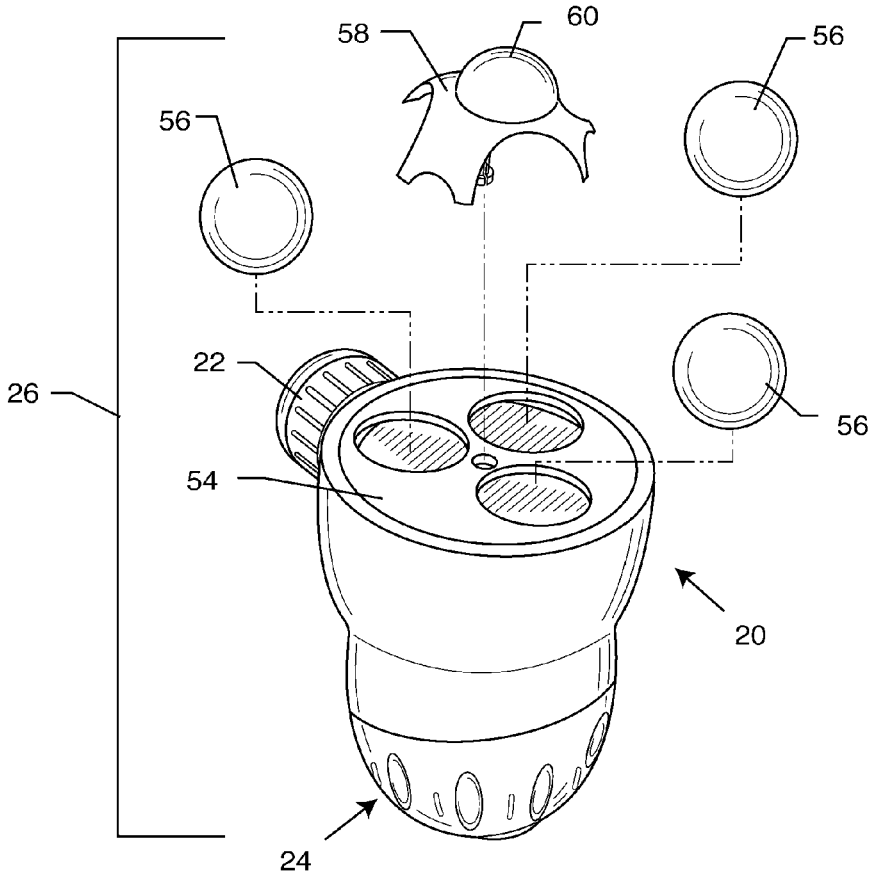
FIG. 14 is an exploded orthogonal view of the second massaging surface of the roller mechanized massager.

As shown in the drawings for purposes of illustration, an embodiment of the present invention resides in a hand-held massage assembly 10. As illustrated in FIGS. 1-5, the hand-held massage assembly 10 includes a roller mechanized massager 20 connectable to a handle 30, which is in turn connectable to a power cord 40. The power cord 40 is connectable to an electrical power supply (not shown), such as an electrical wall socket. Each of the roller mechanized massager 20, the handle 30 and the power cord 40 are equipped with complementary electro-mechanical connections, as will described more fully below.

The roller mechanized massager 20 includes an on/off dial 28, as well as, first and second massage surfaces 24, 26. The first massage surface comprises a hemispherical dome 50 with protrusions 52 located at a pole of the hemispherical surface 50. The protrusions 52 are arranged in a fixed pattern around a pole of the hemispherical surface 52. The second massage surface 26 comprises a flat surface 54 with three spheres 56 recessed therein. The spheres 56 are held in place by a clamp 58 that covers a portion of each sphere 56 and includes a hemispherical protrusion 60 (the Acu•Nob™) from the center of the clamp 58. In operation the second massage surface 26 revolves about a central axis thereof.

The handle 30 includes an articulating joint 36. The articulating joint 36 may be adjusted to various angles to allow a user to reach different portions of his or her body, i.e., back, with relative ease.

As mentioned above, the roller mechanized massager 20 has an electro-mechanical connection 22. The handle 30 has a first electro-mechanical connection 32 at one end and a second electro-mechanical connection 34 at an opposite end. The handle 30 includes electronic wiring (not shown) such that the first electro-mechanical connection 32 is electrically connected to the second electro-mechanical 34. The power cord 40 also has an electro-mechanical connection 42. The electro-mechanical connection 22 on the roller mechanized massager 20 is configured to connect to the first electro-mechanical connection 32 on the handle 30. The electro-mechanical connection 22 includes a power inlet 22*a* and the first electro-mechanical connection 32 includes a power outlet 32*a*. The power inlet 22*a* and power outlet 32*a* are electrically connected when the electro-mechanical connection 22 is joined to the first electro-mechanical connection 32.

In one embodiment the electro-mechanical connection 22 and first electro-mechanical connection 32 comprise male and female threaded connectors respectively. In an alternate embodiment the electro-mechanical connection 22 and first electro-mechanical connection 32 comprise lug and channel connectors.

At the opposite end of the handle 30 the second electro-mechanical connection 34 is configured to connect to the electro-mechanical connection 42 on the power cord 40. The second electro-mechanical connection 34 includes a power inlet 34*a* and the electro-mechanical connection 42 on the power cord 40 includes a power outlet 42*a*. The power inlet 34*a* may be electrically connected to the power outlet 42*a*.

As with the other electro-mechanical connections, the second electro-mechanical connection 34 and electro-mechanical connection 42 on the power cord 40 may comprise male and female threaded connectors respectively. Alternatively, the second electro-mechanical connection 34 and electro-mechanical connection 42 may comprise lug and channel connectors.

The electro-mechanical connections 22 and 42 are configured such that the massage assembly 10 may be assembled without the handle 30. With the handle 30 removed, the power cord 40 is connected directly to the roller mechanized massager 20 by coupling the electro-mechanical connection 22 to the electro-mechanical connection 42. As above the power inlet 22*a* which is part of the electro-mechanical connection 22 is electrically coupled to the power outlet 42*a* which is part of the electro-mechanical connection 42. As with the other electro-mechanical connection pairs, electro-mechanical connections 22 and 42 may comprise either male and female threaded connectors or lug and channel connectors respectively.

While the roller mechanized massager 20, handle 30 and power cord 40 are discussed above in the context of connectors which are engaged by means of male and female threads or lug and channel connectors, the connectors may use various other methods including, but not limited to, slide lock connections, slot and bayonet connections or the like.

The on/off dial 28 is electrically connected to a motor 62 within the roller mechanized massager 20. The motor 62 provides roller mechanized action for the first massaging surface 24. The roller mechanized action provided by the motor 62 provides rotational action to the second massaging surface 26. The on/off dial 28 may comprise a dial that provides increased or decreased speed to the motor. In an alternative embodiment, the motor 62 may provide vibratory action to both the first massaging surface 24 and the second massaging surface 26.

Although an embodiment has been described in detail for purposes of illustration, various modifications may be made without departing from the scope and spirit of the invention.

What is claimed is:

1. A hand held massage assembly, comprising:

a massager having an electro-mechanical connection;

a handle having a first electro-mechanical connection at one end and a second electro-mechanical connection at an opposite end, the first electro-mechanical connection electrically coupled to the second electro-mechanical connection;

wherein the first electro-mechanical connection is coupled to the electro-mechanical connection on the massager;

a power cord having an electro-mechanical connection coupled to the second electro-mechanical connection on the handle; and wherein the handle may be removed and the electro-mechanical connection on the power cord may be coupled to the electro-mechanical connection on the massager.

2. The hand held massage assembly of claim 1, wherein the handle has an articulating joint through which the first electro-mechanical connection remains electrically coupled to the second electro-mechanical connection.

3. The hand held massage assembly of claim 1, wherein the electro-mechanical connection on the massager comprises a threaded male connector and the first electro-mechanical connection on the handle comprises threaded female connector, and wherein the second electro-mechanical connection on the handle comprises a threaded male connector and the electro-mechanical connection on the power cord comprises threaded female connector.

4. The hand held massage assembly of claim 1, wherein the electro-mechanical connection on the massager comprises a channel connector and the first electro-mechanical connection on the handle comprises a lug connector, and wherein the second electro-mechanical connection on the handle comprises a channel connector and the electro-mechanical connection on the power cord comprises a lug connector.

5. The hand held massage assembly of claim 1, wherein the massager has two or more massaging surfaces.

6. The hand held massage assembly of claim 5, further comprising a first massaging surface having a hemispherical surface including three protrusions from a pole of the hemispherical surface, the protrusions arranged in a fixed pattern.

7. The hand held massage assembly of claim 5, further comprising a second massaging surface having three spheres protruding from a flat surface and held in place by a clamp having a central hemispherical protrusion.

8. The hand held massage assembly of claim 7, wherein the second massaging surface revolves about a central axis.

9. The hand held massage assembly of claim 1, wherein the massager includes a motor capable of providing roller mechanized action or vibratory action.

10. A hand held massage assembly, comprising:

a massager having an electro-mechanical connection and two or more massaging surfaces; a handle having an articulating joint, a first electro-mechanical connection at one end and a second electro-mechanical connection at an opposite end, the first electro-mechanical connection electrically coupled to the second electro-mechanical connection;

wherein the first electro-mechanical connection is coupled to the electro-mechanical connection on the massager;

a power cord having an electro-mechanical connection coupled to the second electro-mechanical connection on the handle; and wherein the handle may be removed and the electro-mechanical connection on the power cord may be coupled to the electro-mechanical connection on the massager.

11. The hand held massage assembly of claim 10, wherein the electro-mechanical connection on the massager comprises a threaded male connector and the first electro-mechanical connection on the handle comprises threaded female connector, and wherein the second electro-mechanical connection on the handle comprises a threaded male connector and the electro-mechanical connection on the power cord comprises threaded female connector.

12. The hand held massage assembly of claim 10, wherein the electro-mechanical connection on the massager comprises a channel connector and the first electro-mechanical connection on the handle comprises a lug connector, and wherein the second electro-mechanical connection on the handle comprises a channel connector and the electro-mechanical connection on the power cord comprises a lug connector.

13. The hand held massage assembly of claim 10, further comprising a first massaging surface having a hemispherical surface including three protrusions from a pole of the hemispherical surface, the protrusions arranged in a fixed pattern.

14. The hand held massage assembly of claim 10, further comprising a second massaging surface having three spheres protruding from a flat surface held in place by a clamp having a central hemispherical protrusion.

15. The hand held massage assembly of claim 14, wherein the second massaging surface revolves about a central axis.

16. The hand held massage assembly of claim 10, wherein the massager includes a motor capable of providing roller mechanized action or vibratory action.

17. An hand held massage assembly, comprising:

a massager having an electro-mechanical connection, a first massaging surface having a hemispherical surface including three protrusions from a pole of the hemispherical surface, the protrusions arranged in a fixed pattern, and a second massaging surface having three spheres protruding from a flat surface held in place by a clamp having a central hemispherical protrusion;

a handle having an articulating joint, a first electro-mechanical connection at one end and a second electro-mechanical connection at an opposite end, the first electro-mechanical connection electrically coupled to the second electro-mechanical connection;

wherein the first electro-mechanical connection is coupled to the electro-mechanical connection on the massager;

a power cord having an electro-mechanical connection coupled to the second electro-mechanical connection on the handle; and wherein the handle may be removed and the electro-mechanical connection on the power cord may be coupled to the electro-mechanical connection on the massager.

18. The hand held massage assembly of claim 17, wherein the electro-mechanical connection on the massager comprises a threaded male connector and the first electro-mechanical connection on the handle comprises threaded female connector, and wherein the second electro-mechanical connection on the handle comprises a threaded male connector and the electro-mechanical connection on the power cord comprises threaded female connector.

19. The hand held massage assembly of claim 17, wherein the electro-mechanical connection on the massager comprises a channel connector and the first electro-mechanical connection on the handle comprises a lug connector, and wherein the second electro-mechanical connection on the handle comprises a channel connector and the electro-mechanical connection on the power cord comprises a lug connector.

20. The hand held massage assembly of claim 17, wherein the second massaging surface revolves about a central axis.

21. The hand held massage assembly of claim 17, wherein the massager includes a motor capable of providing roller mechanized action or vibratory action.

* * * * *